US005242542A

United States Patent [19]

Masse et al.

[11] Patent Number: 5,242,542

[45] Date of Patent: Sep. 7, 1993

[54] SOLUTION AND METHOD FOR REMOVING ZINC FROM THE SURFACE OF A GALVANIZED METAL

[76] Inventors: Alain Masse, 4010 de Repentigny, Montreal, Quebec, Canada, H1M 2E7; Donald Murray, 625 Chantal Place, Orleans, Ontario, Canada, K4A 1Z8

[21] Appl. No.: 931,013

[22] Filed: Aug. 17, 1992

[51] Int. Cl.[5] ..... B44C 1/22; C23F 1/00; C09K 13/06

[52] U.S. Cl. ..... 156/656; 134/3; 156/664; 252/79.4

[58] Field of Search ..... 252/79.2, 79.4, 142, 252/146, 147; 134/2, 3, 41; 156/656, 664

[56] References Cited

U.S. PATENT DOCUMENTS

| | | | |
|---|---|---|---|
| 3,337,462 | 8/1967 | Hoornstra et al. | 252/79.4 |
| 4,080,246 | 3/1978 | Battisti et al. | 252/79.4 X |

FOREIGN PATENT DOCUMENTS

| | | |
|---|---|---|
| 575054 | 4/1959 | Canada . |
| 752341 | 2/1967 | Canada . |
| 826622 | 11/1969 | Canada . |
| 894741 | 3/1972 | Canada . |
| 1095805 | 2/1982 | Canada . |
| 1210633 | 9/1986 | Canada . |
| 1261709 | 9/1989 | Canada . |
| 2028195 | 10/1990 | Canada . |

OTHER PUBLICATIONS

Abstract of JP, PN-J 03190999-A, Aug. 20, 1991.
Abstract of US, PN-US 4602963-A, Jul. 29, 1986.
Abstract of JP, PN-J 59211576-A, Nov. 30, 1984.
Abstract of EP, PN-EP-117599-A, Sep. 5, 1984.
Abstract of JP, PN-J 5900917-A, Jan. 18, 1984.
Abstract of JP, PN-J 58157976-A, Sep. 20, 1983.
Abstract of DE, PN-DE 3047088-S, Jul. 29, 1982.
Abstract of EP, PN-EP-53719-A, Jun. 16, 1982.
Abstract of JP, PN-J 57054276-A, Mar. 31, 1982.
Abstract of JP, PN-J 77022331-B, Jun. 16, 1977.
Abstract of US, PN-US 3924035-A, Dec. 2, 1975.
Abstract of JP, PN-J 74043174-B, Nov. 19, 1974.
Abstract of DE, PN-DE 2412134-A, Oct. 3, 1974.
Abstract of DE, PN-DE 2305821-A, Aug. 14, 1974.
Abstract of NL, PN-NL 7303860-A, Sep. 7, 1978.
Abstract of DE, PN-DE 1621487-B, Jan. 1900(7017).
Abstract of NL, PN-NL 6912687-A, Jan. 1969(7009).
Abstract of FR, PN-FR 2029321-A, Jan. 1974(7103).
Abstract of US, PN-US 3524817-A, Jan. 1970(7033).

*Primary Examiner*—William A. Powell
*Attorney, Agent, or Firm*—Collard & Roe

[57] ABSTRACT

The invention relates to a solution for removing zinc on the surface of a galvanized metal part, said solution comprising: phosphoric acid; alcohol of formula R—OH where R is an alkyl radical having from 1 to 6 carbon atoms; hydroquinone; and water. The invention also relates to a method for removing zinc on the surface of a galvanized metal part, said method comprising the steps of: preparing a solution containing phosphoric acid, alcohol of formula R—OH where R is an alkyl radical having from 1 to 6 carbon atoms, hydroquinone, and water; dipping said part in a bath of said solution; and removing said part from said bath and rinsing it.

21 Claims, No Drawings

SOLUTION AND METHOD FOR REMOVING ZINC FROM THE SURFACE OF A GALVANIZED METAL

BACKGROUND OF THE INVENTION a) Field of the invention

This invention relates to an acid solution for removing zinc on the surface and in the pores of a galvanized metal (especially a galvanized steel) part. The invention also relates to a method for removing zinc on the surface and in the pores of a galvanized metal (especially a galvanized steel) part for the purpose of recycling and reusing said part.

b) Description of the prior art

Multiple etching solutions exist to clean surfaces of metal or take off the zinc coating on steel. However, etching takes place in strong acid or basic conditions that may be harmful to the user. Also, as sand-blasting will do, the integrity of the surface of the metal is affected by the acid or alkaline solution which may cause embrittlement or blistering. For recycling purposes, embrittlement or blistering must be avoided to ensure integrity (i.e. strength) of the structure to be cleaned.

Japanese patent application 84-211,576 discloses a solution of strong alkali to remove Zn coating film before soldering. However, the operation must be done on the exact site of the removal because the solution injures the metal surface.

Japanese patent application 84-009,174 discloses a solution that partially removes Zn coating film The solution comprises a high concentration of sulphuric acid that may alter the integrity of the metal surface and cause hydrogen embrittlement.

German patent 3,047,088 discloses a method for removing zinc from metal strips comprising an acid treatment followed by neutralization with an alkaline solution. Once again, this procedure involves use of very strong acid solutions that may present danger for the user. Furthermore, the acid must be neutralized before the cleaned part can be used.

Japanese patent application 77-022,331 discloses a bath for removing a Zn coating formed on steel surfaces, this solution comprising persulfate, organic complexing agents such a citric acid, EDTA or tartaric acid.

U.S. Pat. No. 3,634,217 discloses a solution for removing previously defined amounts of metal from a metal surface. The solution consists of aqueous alkaline solution and chelateforming agents.

French patent 2,029,321 discloses a cleaning solution comprising 15–33% by wt. of phosphoric acid and corrosion inhibitors such as aldehydes or urea derivatives.

It has now been found that an acid solution in admixture with a wetting agent and an inhibitor can be a very efficient solution for removing zinc coating on galvanized metal (especially a galvanized steel) parts both on the outer surface and in the pores of the metal. This solution does not present danger for the human as a user may dip one hand in it without being burned or harmed. The method for removing zinc does not leave any trace of corrosion on the metal and does not cause embrittlement or blistering so that the metal parts may be reused for their original purpose.

It is a first object of this invention to provide a solution for removing zinc coating on the surface of galvanized metal (especially a galvanized steel).

It is another object of this invention to remove zinc coating without affecting the integrity of the metal surface.

It is a further object of this invention to recycle old galvanized metal (especially steel) parts for their original purpose.

It is still a further object of this invention to provide a solution for removing zinc that can be reused many times without hampering its effect.

It is a further object of this invention to provide a safe solution for such a purpose so that humans that manipulate it are not exposed to danger.

It is a further object of this invention to provide a solution allowing to work cold (i.e. at room temperature) to thus save energy.

Still, it is a further object of this invention to provide a solution that allows to recover the zinc in a substantially solid form.

SUMMARY OF THE INVENTION

In accordance with these objects, there is provided a solution for removing zinc on the surface of galvanized metal (especially a galvanized steel), said solution comprising:

phosphoric acid, alcohol of formula R—OH where R is an alkyl having for 1 to 6 carbon atoms, hydroquinone, and water.

Preferably, the alcohol is used as a wetting agent and may be isopropyl alcohol.

The invention also provides a method for removing zinc coating on a the surface of a galvanized metal (especially a galvanized steel) part, said method comprising the steps of:

preparing a solution comprising: phosphoric acid, alcohol of formula R—OH where R is an alkyl radical having from 1 to 6 carbon atoms, hydroquinone, and water;

soaking said part in a bath of said solution, (preferably for approximately 5 to 15 minutes at room temperature); and removing said part from said bath and rinsing it (for example with water).

Preferably a concentration of between 15% to 30% wt/vol (preferably 20% wt/vol) of phosphoric acid is used. Although, this gives a solution of pH between about 1 and 1.5, it seems that it is not harmful for a human. Indeed, experiments have proven that a person soaking one hand in the solution for many seconds will not be harmed. The explanation for this phenomenon is not known to the Applicant but has been repeatedly proven.

Although it is believed that any C1 to C6 alkyl alcohol may be used as a wetting agent, it is preferable to use isopropyl alcohol. The alcohol may be at a concentration of approximately 2.5% (vol/vol).

The hydroquinone is believed to act as an inhibitor and may be the cause for the non-corrosive action of the phosphoric acid on human body. Preferably, hydroquinone may be used at a final concentration varying from 0.003M to 0.010M.

EXAMPLE 1

A solution is made with:

3.78 liters of 85% phosphoric acid (wt/vol), 0.38 liter of isopropyl alcohol (99%), 12 grams of hydroquinone (approximately 0.11 moles) and 12.48 liters of water.

The pH of the solution is approximately 1.5 .

A piece of galvanized steel provided with a 90 micron-thick layer of zinc is deposited in a bath of this solution and the effect on the surface is observed. After 2 to 5 minutes all corrosion present on the surface has disappeared. After 5 to 15 minutes without agitation or heating or any other means of activating the reaction, the outer surface as well as the inner pores of the metal piece are free of any trace of zinc.

It has been noted that a slurry forms at the bottom of the bath. This slurry is rich in zinc and can be recovered to isolate the zinc and recycle it.

The piece of metal is completely devoid of traces of the layer of zinc. Also, has assessed by microscopic examination, the surface and the inner pores of the metal are not affected by the treatment and do not show any signs of hydrogen embrittlement or blistering.

What is claimed is:

1. A solution for removing zinc on the surface of a galvanized metal part, said solution comprising:

phosphoric acid;

alcohol of formula R—OH where R is an alkyl radical having from 1 to 6 carbon atoms;

hydroquinone; and water.

2. A solution according to claim 1, wherein the galvanized metal part is a galvanized steel part.

3. A solution according to claim 2, wherein said alcohol is isopropyl alcohol.

4. A solution according to claim 2, wherein said phosphoric acid is at a concentration varying from 15 to 30% (wt/vol).

5. A solution according to claim 3, wherein said phosphoric acid is at a concentration of approximately 20% (wt/vol).

6. A solution according to claim 2, wherein said hydroquinone is at a concentration of about 0.003M to 0.010M.

7. A solution according to claim 3, wherein said hydroquinone is at a concentration of about 0.003M to 0.010M.

8. A solution according to claim 7, wherein said hydroquinone is at a concentration about 0.007M.

9. A solution according to claim 2, wherein said alcohol is at a concentration of approximately 2.5% (vol/vol).

10. A solution according to claim 3, wherein said alcohol is at a concentration of approximately 2.5% (vol/vol).

11. A method for removing zinc on the surface of a galvanized metal part, said method comprising the steps of:

preparing a solution containing phosphoric acid, alcohol of formula R—OH where R is an alkyl radical having from 1 to 6 carbon atoms, hydroquinone, and water;

dipping said part in a bath of said solution; and removing said part from said bath and rinsing it.

12. A method according to claim 11, for removing zinc on the surface of galvanized steel part, said method comprising the steps of:

preparing a solution containing phosphoric acid, alcohol of formula R—OH where R is an alkyl radical having from 1 to 6 carbon atoms, hydroquinone, and water;

dipping said part in a bath of said solution for at least 5 to 15 minutes at room temperature; and removing said part from said bath and rinsing it with water.

13. A method according to claim 12, wherein said phosphoric acid concentration is varying from 15% to 30% (wt/vol).

14. A method according to claim 12, wherein said phosphoric acid concentration is approximately 20% (wt/vol).

15. A method according to claim 13, wherein said alcohol is isopropyl alcohol.

16. A method according to claim 14, wherein said alcohol is isopropyl alcohol.

17. A method according to claim 15, wherein said isopropyl alcohol is at a concentration of approximately 2.5% (vol/vol).

18. A method according to claim 16, wherein said isopropyl alcohol is at concentration of approximately 2.5% (vol/vol).

19. A method according to claim 12, wherein said hydroquinone is at a concentration of approximately 0.003M to 0.010M.

20. A method according to claim 18, wherein said hydroquinone is at a concentration of approximately 0.003M to 0.010M.

21. A method according to claim 19, wherein said hydroquinone is at a concentration of about 0.007M.

* * * * *